United States Patent [19]

Aramaki

[11] Patent Number: 4,950,952

[45] Date of Patent: Aug. 21, 1990

[54] PHOTOCATHODE AND METHOD OF MANUFACTURING THE SAME

[75] Inventor: Yoshimitsu Aramaki, Tokyo, Japan

[73] Assignee: Kabushiki Kaisha Toshiba, Kawasaki, Japan

[21] Appl. No.: 408,462

[22] Filed: Sep. 15, 1989

Related U.S. Application Data

[63] Continuation of Ser. No. 169,477, Mar. 17, 1988, abandoned.

[30] Foreign Application Priority Data

Mar. 18, 1987 [JP] Japan ..... 62-61070

[51] Int. Cl.[5] ..... H01J 40/06; B05D 5/12

[52] U.S. Cl. ..... 313/542; 313/527; 313/373; 427/78

[58] Field of Search ..... 313/527, 539, 541–544, 313/373; 250/213 VT; 427/74, 77, 78

[56] References Cited

U.S. PATENT DOCUMENTS

| | | | |
|---|---|---|---|
| 3,697,794 | 10/1972 | Stoudenheimer et al. | 313/542 |
| 4,002,735 | 1/1977 | McDonie et al. | 427/78 |
| 4,160,185 | 7/1979 | Tomasetti et al. | 313/542 |
| 4,331,701 | 5/1982 | McDonie | 427/74 X |

FOREIGN PATENT DOCUMENTS

| | | | |
|---|---|---|---|
| 1251882 | 10/1967 | Fed. Rep. of Germany | 427/77 |
| 2813218 | 3/1978 | Fed. Rep. of Germany . | |
| 7526767 | 2/1976 | France . | |
| 46-15696 | 4/1971 | Japan . | |
| 1600904 | 3/1978 | United Kingdom . | |
| 1600905 | 3/1978 | United Kingdom . | |

OTHER PUBLICATIONS

Patent Abstracts of Japan, vol. 10, No. 27 (E-378) [2084], 4th Feb. 1986; & JP-A-60 185 349 (Toshiba K.K.) 20-09-1985.

*Primary Examiner*—Donald J. Yusko
*Assistant Examiner*—Michael Horabik
*Attorney, Agent, or Firm*—Cushman, Darby & Cushman

[57] ABSTRACT

The present invention provides a photocathode which is formed on a substrate consisting of polycrystalline members, and which mainly consists of a semimetal, manganese or silver, and one or a plurality of alkaline metals, characterized in that the photocathode is formed on an alkaline metal oxide layer formed on the substrate, and a composition ratio of the semimetal, manganese or silver, and the one or a plurality of alkaline metals is stoichiometric or almost stoichiometric. The photocathode of the present invention has high sensitivity and can stably maintain the sensitivity for a long period of time.

12 Claims, 4 Drawing Sheets

PHOTOCATHODE AND METHOD OF MANUFACTURING THE SAME

This is a continuation of application No. 07/169,477, filed Mar. 17, 1988, which was abandoned upon the filing hereof.

BACKGROUND OF THE INVENTION

1. Field of the Invention

The present invention relates to a photocathode which is formed on a member having fine spaces or pores and maintains high sensitivity for a long period of time and a method of manufacturing the same.

2. Description of the Related Art

An example of an electron tube having a photocathode is an X-ray image intensifier. As shown in FIG. 1, this X-ray image intensifier has columnar member 1 consisting of, e.g., a polycrystalline alkali halide for absorbing X-rays 3 and emitting light as a substrate and photocathode (photoelectron conversion layer) 2 formed on this substrate and consisting of a semimetal and an alkaline metal. Reference numerals 4, 5, 6, 7, and 8 represent electron beams, a focusing electrode, an electron lens, an output fluorescent screen, and the X-ray image intensifier, respectively. Substrate 1 converts incident X-rays 3 into visible light, and photocathode 2 emits photoelectrons by a photoelectric effect caused by the visible light. Lens 6 accelerates the photoelectrons and converges them to focus an electron image on screen 7. Screen 7 converts the electron image into a visible image.

The X-ray image intensifier is mainly used for medical diagnosis. Therefore, in order to reduce an X-ray exposure amount of an object to be examined, a demand has arisen for a photocathode of an X-ray image intensifier which has high photocathode sensitivity and can stably maintain the sensitivity for a long period of time.

In order to increase the sensitivity of the photocathode, its composition ratio must be a stoichiometric composition ratio determined by valences of constituent elements or a composition ratio close to it, as described in many articles. For example, in a multi-alkali photocathode consisting of a semimetal Sb (tervalent) and alkaline metals (monovalent) Cs, Na and K, a stoichiometric composition ratio of Sb and a total sum of the alkaline metals is theoretically 1 : 3. If the photocathode has a composition ratio other than the above composition ratio or the composition ratio changes over time, the sensitivity is reduced.

A substrate consisting of a luminescent polycrystalline material such as CsI/Na, $Gd_2O_2S$/Tb, CsI/Tl etc. is formed by a physical deposition method such as vacuum evaporation or sputtering or a chemical deposition method such as CVD. Therefore, in this substrate, unlike in a photocathode of other electron tubes having a substrate of amorphous glass or a metal plate, a large number of grain boundaries, narrow spaces, lattice defect, or pores are inevitably generated. For example, as shown in FIG. 2, when CsI/Na is used, substrate 1 is formed such that light propagates in the longitudinal direction of the columnar polycrystalline of several micrometer-wide CsI/Na and reaches photocathode 2. With this structure, diffusion of the light in the substrate can be reduced, and a large amount of light can be absorbed and incident on the photocathode.

A photocathode consisting of a semimetal such as Sb, Bi, Te etc. and an alkaline metal is formed by, e.g., chemical reaction between the semimetal deposited on a substrate and the alkaline metal effected thereto. However, if narrow spaces or grain boundaries are generated in the substrate as described above, the alkaline metal enters into the narrow spaces, grain boundaries or even crystal itself to change a stoichiometric composition ratio of the photocathode.

For this reason, an interlayer of $Al_2O_3$, $In_2O_3$, or the like formed by vacuum evaporation is conventionally interposed between the substrate and the photocathode. However, pores or grain boundaries are still generated in the interlayer although they are not so large as those in the substrate, thereby reducing the sensitivity.

FIG. 3 shows results of Auger analysis of a photocathode consisting of a semimetal and a plurality of alkaline metals (Na, K, and Cs) formed on a columnar polycrystal of sodium activated cesium iodide (CsI/Na) through an interlayer of $Al_2O_3$. A sputtering time of a rare gas plotted along the abscissa represents a thickness of the photocathode. According to FIG. 3, a composition ratio of Sb and a total sum of the alkaline metals is ranges from 1 : 35 to 1 : 40, i.e., largely differs from the above stoichiometric composition ratio. In addition, the concentration of Cs is significantly high. This is because when a substrate of a polycrystalline member is used, photocathode sensitivity is largely reduced over time. Therefore, in order to compensate for this reduction, the composition ratio is largely shifted from the stoichiometric composition ratio at the cost of sensitivity in an initial stage of use.

SUMMARY OF THE INVENTION

The present invention has been made in consideration of the above situation and has as its object to provide a photocathode which is formed on a substrate consisting of one or a plurality of members having surfaces with a large number of fine spaces or pores, and which mainly consists of a semimetal, manganese or silver, and one or a plurality of alkaline metals, characterized in that the photocathode is formed on an alkaline metal oxide layer formed on the substrate, and a composition ratio of the semimetal, manganese or silver, and the one or a plurality of alkaline metals is stoichiometric or almost stoichiometric.

It is another object of the present invention to provide a method of forming a photocathode mainly consisting of a semimetal, manganese or silver, and one or a plurality of alkaline metals on a substrate consisting of one or a plurality of members having surfaces with a large number of narrow spaces or pores characterized in that the method of forming a photocathode comprises the steps of: forming an alkaline metal oxide layer on the substrate; and forming, on the alkaline metal oxide layer, the photocathode in which a composition ratio of the semimetal, manganese or silver, and the one or a plurality of alkaline metals is stoichiometric or almost stoichiometric.

DETAILED DESCRIPTION OF THE PREFERRED EMBODIMENT

According to the present invention, a compact interlayer consisting of an alkaline metal oxide is interposed between a polycrystalline substrate and a photocathode. Therefore, migration or diffusion of the alkaline metal as a component of the photocathode or chemical reaction between the substrate material or contained material in the substrate and the alkaline metal can be reduced, thereby preventing a change in composition ratio of the photocathode.

The alkaline metal oxide layer transmits light having a wavelength absorbed by the photocathode which is formed on this layer and contains the alkaline metal. This is because an oxide of an alkaline metal has a band gap wider than that of a compound of an alkaline metal of the same type and a semimetal, and therefore is transparent throughout a wide wavelength range. For this reason, when an intermediate layer of the alkaline metal oxide is interposed in a transmission-type photocathode, light transmission efficiency is scarcely adversely affected.

An alkaline metal has a high vapor pressure. Therefore, an alkaline metal can be gasified from an alkaline metal dispenser to be uniformly distributed in a space of an electron tube envelope in which a substrate is placed and adhered on the entire surface of the substrate. Since an alkaline metal has high mobility, the alkaline metal adhered on the substrate surface can be moved or diffused into the grain boundaries or fine spaces. Thereafter, an oxygen gas is introduced to form an alkaline metal oxide layer. In this case, since the introduced oxygen is also gaseous, it can be uniformly distributed in the space in which the substrate is placed and brought into contact with the alkaline metal adhered on the entire surface of the substrate beforehand. An alkaline metal has high activity and therefore immediately forms an alkaline metal oxide together with the oxygen. As a result, a compact alkaline metal oxide layer is distributed on the entire surface of the substrate. In addition, since an alkaline metal oxide layer is chemically stable, it is not decomposed upon formation of a photocathode and therefore can stably serve as an effective barrier of the photocathode with respect to the substrate.

A thickness of the photocathode is preferably 1,000 Å or less though it depends upon the composition of the photocathode. This is because if the thickness exceeds 1,000 Å, the conversion efficiency of photoelectrons is reduced. A thin alkaline metal oxide layer is preferred, provided that it prevents the alkaline metal from diffusing or penetrating into a substrate or reacting with a substrate.

EXAMPLE

Figure 1:
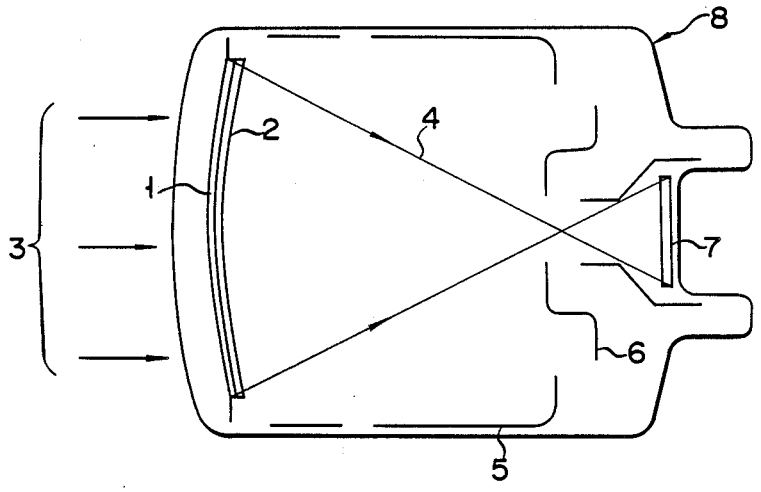
FIG. 1 (PRIOR ART)
FIG. 1 is a schematic sectional view of an X-ray image intensifier.
Figure 2:
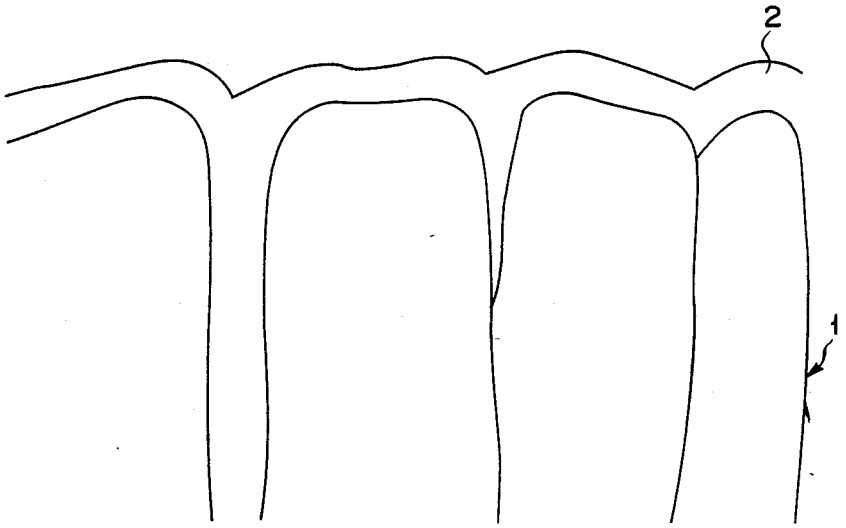
FIG. 2 (PRIOR ART)
FIG. 2 is an enlarged schematic sectional view of a conventional photocathode and substrate.

A substrate consisting of a columnar polycrystal of CsI/Na denoted by reference numeral 1 in FIG. 2 was housed in an envelope of an X-ray image intensifier. The envelope was evacuated while it was heated up to a temperature of 50° to 350° C. Then, the substrate was maintained at 50° to 300° C. and alkaline metal K was introduced from a heated dispenser. K collided against the substrate at a speed represented by a function of its atomic weight and a temperature and was partially adsorbed. In this case, K is adsorbed not only on the surface of the substrate but also into the grain boundaries or narrow spaces thereof. K is also absorbed in a large number of lattice defects in polycrystals. Furthermore, K is sometimes absorbed in crystals by thermal diffusion. Whether the alkaline metal is fully deposited can be examined from the saturation of photocurrent.

Figure 4:
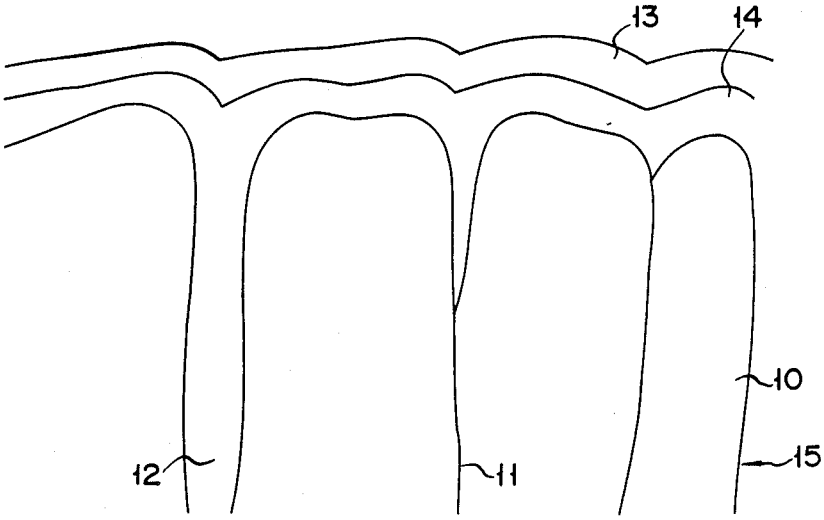
FIG. 4 is an enlarged schematic sectional view of a photocathode according to one embodiment of the present invention.

Then, a sufficient amount of an oxygen gas for oxidizing K which covered the substrate was introduced in the electron tube envelope. As a result, K which covered the substrate was oxidized by the introduced oxygen, and the entire surface of the substrate was covered with potassium oxide 14 as shown in FIG. 4. The introduction and oxidation of the alkaline metal can be repeated several times to cover the substrate entirely with alkaline metal oxide layer.

Thereafter, the substrate on which the potassium oxide layer was formed was maintained at 50° to 200° C. and the photocathode is formed thereon. The process of forming the photocathode is basically same as that disclosed in other literatures. Sb was deposited on the potassium oxide layer. Then, K and Cs were effected to the deposited Sb. After the photocurrent has come to a peak, Sb and Cs were alternately deposited, thereby forming a photocathode consisting of Sb, K, and Cs. A surface of the photocathode which faces a fluorescent screen should preferably contain a larger number of atoms of other alkaline metals than of cesium.

FIG. 4 is an enlarged schematic sectional view of the substrate, the potassium oxide layer, and the photocathode formed as described above. The surface of substrate 15 consisting of columnar polycrystals 10 of CsI/Na has projections of columnar polycrystals 10 and therefore has a large area. A large number of grain boundaries 11 and narrow spaces 12 extending toward the surface are present between columnar polycrystals 10. Potassium oxide layer 14 enters into grain boundaries 11 and narrow spaces 12 to cover the entire surface of substrate 15. Layer 14 is compact enough to perfectly separate substrate 15 and photocathode 13 in the order of almost the size of an atom. When the gaseous alkaline metal and the oxygen gas are alternately repeatedly introduced, a more compact alkaline metal oxide layer can be formed.

Figure 3:
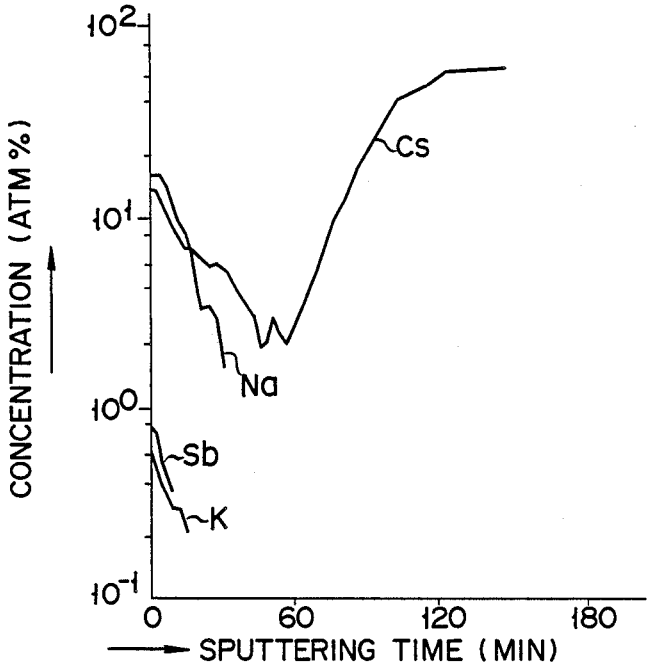
F I G. 3 (PRIOR ART)
FIG. 3 is a graph of Auger analysis of a conventional photocathode.
Figure 5:
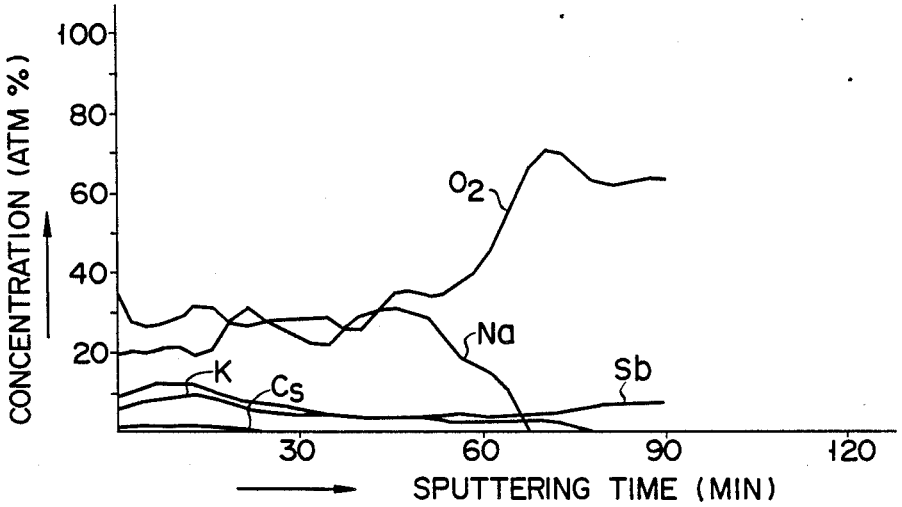
FIGS. 5 and 6 are graphs of Auger analysis of the photocathode according to one embodiment of the present invention.

FIG. 5 shows results obtained from Auger analysis of the obtained photocathode in the thickness direction. As is apparent from FIG. 5, a composition ratio of the semimetal Sb with respect to the total sum of the alkaline metals of this photocathode is 1/5 to 5/3 a desired stoichiometric composition ratio for a photocathode, which is different from the conventional composition ratio exemplified in FIG. 3. A composition ratio of each alkaline metals except Cs does not exceed the range of 1/10 to 10 times a stoichiometric composition.

The oxygen is mixed in because the Auger analysis must be performed after the resultant material is taken out into the atmosphere.

Figure 6:
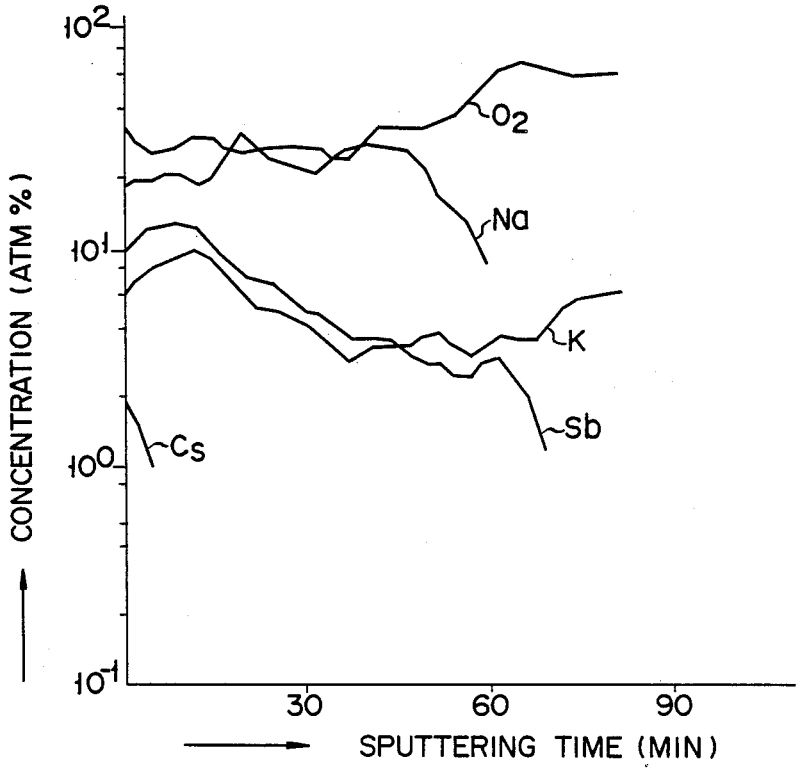

FIG. 6 is a graph in which the ordinate of FIG. 5 represents the logarithm. As is more apparent from FIG. 6, the obtained photocathode has a composition ratio closer to a stoichiometric composition ratio compared with the conventional photocathode formed on a polycrystalline member. It is found that Na migrated from the CsI/Na substrate by thermal diffusion upon formation of the photocathode.

As a result of the Auger analysis, no carbon was found in the photocathode of the present invention. If carbon is present in the photocathode, a work function concerning photoemission is increased. Therefore, the intense X-ray is undesirably required. However, if a photocathode is formed in accordance with the method of the present invention, an alkaline metal oxide layer prevents the carbon present as an impurity on the substrate surface from mixing into the photocathode, thereby increasing photocathode sensitivity.

In the above embodiment, the alkaline metal oxide layer is formed directly on the substrate of the polycrystalline member, and the photocathode is formed on the alkaline metal oxide layer. A thickness of the photocathode is 1000 Å or less. Furthermore, the semimetal which is one of the constituents of the photocathode and deposited firstly on the substrate is deposited on the substrate in a direction perpendicular to the thickness direction. Therefore, if, for example, fine spaces of the polycrystalline member are deeper than the thickness of the photocathode, continuity of the photocathode in a direction perpendicular to the thickness direction may be degraded.

Figure 7:
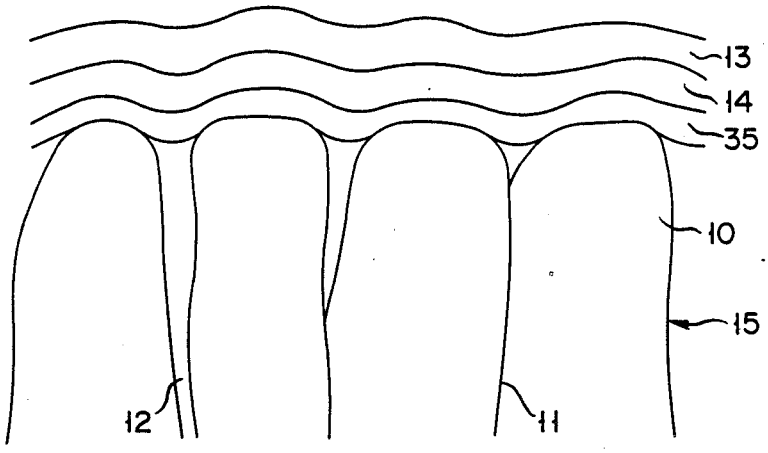
FIG. 7 is an enlarged schematic sectional view of a photocathode according to the other embodiment of the present invention.

In this case, as shown in FIG. 7, interlayer 35 formed by a conventional method may be provided between alkaline metal oxide layer 14 and substrate 15. Intermediate layer 35 is formed by deposition or the like and therefore consists of a porous or polycrystalline layer. Intermediate layer 35 covers fine spaces 12 of the polycrystalline members to compensate for its transverse continuity and serves substantially as a substrate for a photocathode formed on the polycrystalline member.

In addition, Sb, Mn, or Ag may be oxidized upon formation of a photocathode to form a photocathode having spectral sensitivity offset to red.

What is claimed is:

1. A photocathode assembly comprising:

a substrate consisting essentially a polycrystalline alkaline metal halide;

a photocathode formed on said substrate and mainly consisting of a semimetal and at least one element selected from alkaline metals; and an alkaline metal oxide layer being interposed between said photocathode and said substrate.

2. A photocathode assembly according to claim 1, wherein a composition ratio of the semimetal and the at least one element selected from alkaline metals is stoichiometric or mostly stoichiometric.

3. A photocathode according to claim 11, wherein a surface region of said photocathode which faces a fluorescent screen contains a larger number of atoms of other alkaline metals than of cesium.

4. A photocathode assembly according to claim 2, wherein said semimetal is antimony, and a composition ratio of antimony and the alkaline metals other than cesium is 1 : 0.1 to 1 : 10.

5. A photocathode assembly according to claim 2, wherein said semimetal is antimony and the alkaline metals are cesium and elements other than cesium, and a composition ratio of antimony to the alkaline metals other than cesium is 1:0.1 to 1:10.

6. A photocathode assembly according to claim 2, wherein said photocathode contains oxygen.

7. A photocathode assembly according to claim 6, wherein oxygen is bonded to the semimetal, manganese, or silver.

8. A method of forming a photocathode, comprising the steps of:

forming an alkaline metal oxide layer on a substrate consisting essentially of a polycrystalline alkali metal halide and forming, on said alkaline metal oxide layer, a photocathode mainly consisting of a semimetal and one or a plurality of alkaline metals, wherein a composition ratio of the semimetal and the one or a plurality of types of alkaline metals is stoichiometric or mostly stoichiometric.

9. A method according to claim 8, wherein said forming an alkaline metal oxide layer is performed by oxidizing an alkaline metal deposited on said substrate.

10. A method according to claim 9, wherein said depositing an alkaline metal and oxidizing an alkaline metal are alternately repeated.

11. A photocathode assembly according to claim 2, wherein said at least one alkaline metals includes cesium.

12. A photocathode assembly according to claim 1, wherein a porous or polycrystalline intermediate layer is provided between said substrate and said alkaline metal oxide layer.

* * * * *